United States Patent [19]

Stockdale et al.

[11] 4,100,543

[45] Jul. 11, 1978

[54] AUDIBLE ALARM APPARATUS PARTICULARLY ADAPTABLE FOR USE WITH FIRE AND THEFT SECURITY SYSTEMS

[75] Inventors: Roy Stockdale, Huntington; Lance Weston, Babylon, both of N.Y.

[73] Assignee: Napco Security Systems, Inc., Copiaque, N.Y.

[21] Appl. No.: 765,539

[22] Filed: Feb. 4, 1977

[51] Int. Cl.[2] ..... G08B 19/00

[52] U.S. Cl. ..... 340/521; 307/279; 331/108 C; 340/574; 340/584; 340/384 E

[58] Field of Search ..... 340/384 E, 420; 331/108 C; 307/279, 208, 214

[56] References Cited

U.S. PATENT DOCUMENTS

| | | | |
|---|---|---|---|
| 3,794,934 | 2/1974 | Rhee | 331/108 C |
| 3,992,973 | 11/1976 | Howell | 307/208 |

OTHER PUBLICATIONS

Cousino, R. E. "IC Doorbell Plays Your Song" Radio-Electronics, vol. 46, No. 9, pp. 33–35, New York.

Scholten, J. W. "IC–Incorporated MOS Oscillators. . ." Components Report, vol. 10, No. 5, pp. 129–133, Germany.

Edwards, D. "Digital Metronome with Accented Beat "Electronics Australia, vol. 38, No. 4, pp. 40–41, Australia.

*Primary Examiner*—Glen R. Swann, III

*Attorney, Agent, or Firm*—Arthur L. Plevy

[57] ABSTRACT

The alarms circuit provides a first signal indicative of a fire alarm and a second signal indicative of another intrusion such as a burglary. The circuit includes a high frequency RC oscillator which undesireably possesses a duty cycle different from fifty percent. The oscillator output is divided by a bistable multivibrator to produce at an output, a divided signal having a fifty percent duty cycle for application to a loud speaker to energize the same efficiently due to the proper duty cycle. In a burglary mode, the oscillator frequency is modulated by a sawtooth developed by a second bistable multivibrator to provide a wailing tone signal indicative of a burglary. This signal is also divided to produce a proper duty cycle signal for application to the loud speaker.

10 Claims, 1 Drawing Figure

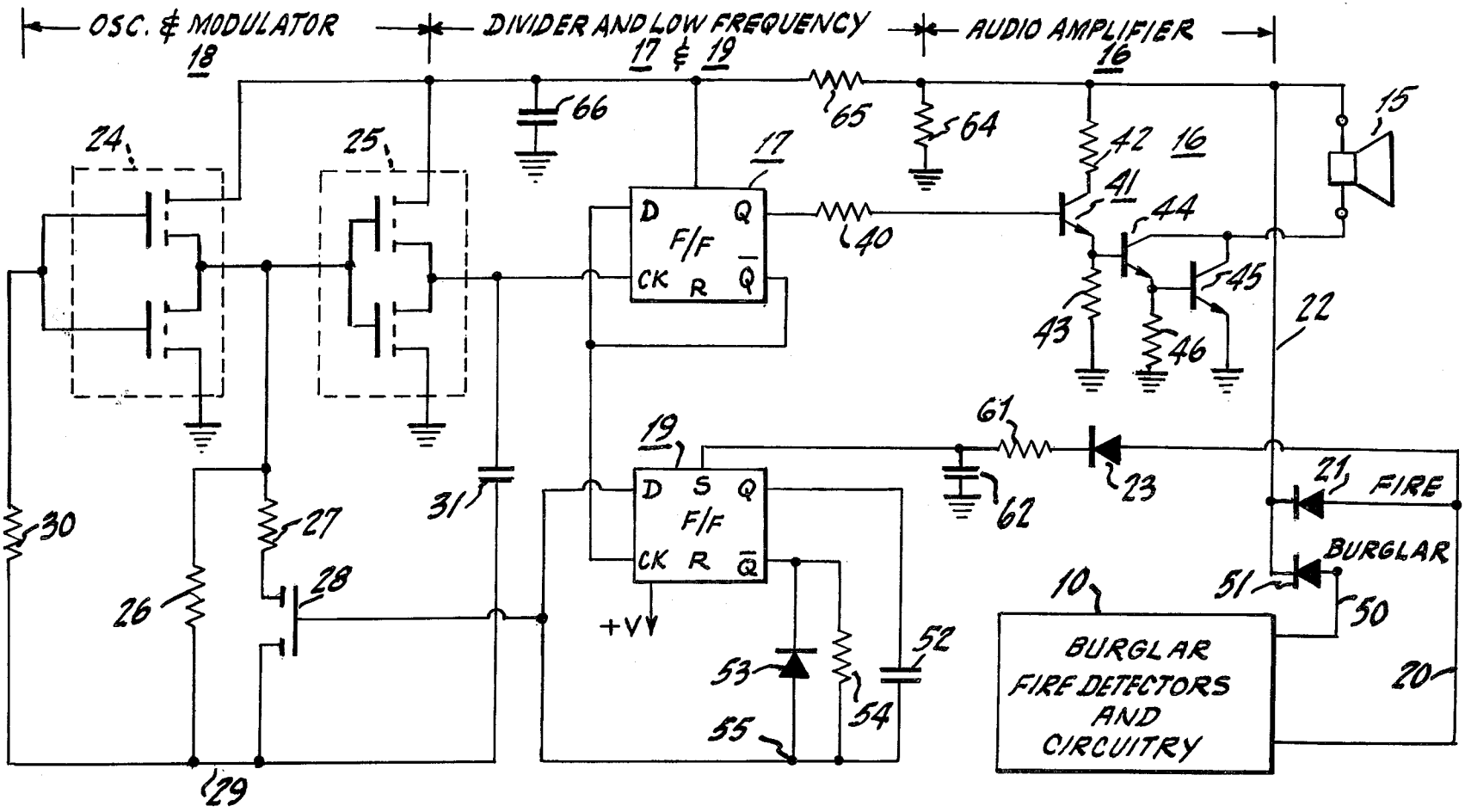
OSC. & MODULATOR 18
DIVIDER AND LOW FREQUENCY 17 & 19
AUDIO AMPLIFIER 16
BURGLAR FIRE DETECTORS AND CIRCUITRY
FIRE
BURGLAR
F/F
D
CK
Q
R
S
+V

AUDIBLE ALARM APPARATUS PARTICULARLY ADAPTABLE FOR USE WITH FIRE AND THEFT SECURITY SYSTEMS

BACKGROUND OF INVENTION

As is well known, a normal requirement for many types of burglar and fire alarm systems requires activation of an audible alarm to provide an indication of a monitored intrusion on the premises.

Many such systems serve a dual purpose to monitor both an unauthorized intrusion on the premises as well as monitoring or detecting a fire and to provide a suitable alarm for such undesired conditions.

In general, the systems employ a common alarm to indicate either a burglary, a fire or some other improper condition on the premises. In order to distinguish between an intrusion or another monitored condition, the common alarm or siren is activated by a different signal for a different condition. The user can then determine the condition by listening to the particular alarm.

One of the signals, for example, may be a steady tone which is generally used to denote a fire, while the other signal provides a wailing tone which may be indicative of an unauthorized intrusion such as the presence of a burglar.

A great many of such devices employ an audio amplifier and speaker arrangement to provide an audible signal indicative of the particular intrusion. A great many of these devices employ a high frequency oscillator which is shifted in frequency or modulated by a suitable low frequency to produce the audible or wailing frequency. The output of the same oscillator is used without the modulation or frequency shift to provide the steady tone signal indicative of a fire.

In any event, conventional ways of modulating or shifting certain high frequency oscillators serve to provide distortion which effects the duty cycle of the oscillator or the on/off ratio. Due to a change in the duty cycle, the audio amplifier circuits drive the speaker inefficiently and hence, the distortion results in providing a reduction in the effective output power in the loud speaker. The loud speaker and associated circuitry operate most efficiently with a symmetrical waveform applied thereto which is indicative of equal on and off time, each comprising for example, fifty percent of one cycle.

Thus, on most conventional alarm systems, the high frequency signal is normally between for example, 750 to 2,500 Hz. This signal is usually modulated at the rate of a few cycles per second to provide the wailing signal. During modulation, the oscillator loses symmetry as indicated above and hence, the audio circuit as well as the speaker operate at a reduced power level. It is, of course, understood that this result is undesireable as the lower power level results in a lower intensity audio alarm which therefore, has a reduced transmission range and hence, limits the area over which the alarm can be heard.

It is therefore an object of the present invention to provide an improved apparatus for driving a loud speaker alarm circuit to maintain an optimum power level, while further providing an economical and efficient way of producing a wailing tone.

BRIEF DESCRIPTION OF PREFERRED EMBODIMENT

A circuit for providing an audible alarm at a given frequency energizes a loud speaker device at said frequency, said frequency provided by a RC controlled oscillator for providing a signal frequency at an output and having an undesireable variation in duty cycle to thereby result in a reduction in the power applied to said loudspeaker. The improvement comprises apparatus for providing approximately a fifty percent duty cycle to said loud speaker, comprising a triggerable frequency divider coupled to said oscillator output and operative to divide said signal frequency by a factor of $2n$, where $n$ is a positive integer, said divider operative to provide a divided signal having a fifty percent duty cycle relatively independent of the frequency and duty cycle of said oscillator and means for applying said divided signal to said loud speaker device.

BRIEF DESCRIPTION OF FIGURES

The sole FIGURE is a schematic diagram depicting an embodiment of the apparatus according to this invention.

DETAILED DESCRIPTION OF PREFERRED EMBODIMENT

Referring to the FIGURE, there is shown a module 10 which is entitled BURGLAR, FIRE DETECTORS AND CIRCUITRY. Basically, the module 10 consists of a series of well known components which may be provided or installed in or about an area to be protected to monitor windows, doors and so on in regard to an unauthorized intrusion and may further comprise temperature detectors or smoke detectors which are responsive to changes in heat or the presence of smoke to provide a switch closure or signal when an unauthorized condition is present within the area under surveillance. There are, of course, many such systems and devices which can be employed in monitoring a desired area in order to provide an indication of a potential threat to the premises.

For purposes of explanation, there is indicated in the FIGURE, one input labelled FIRE and another labelled BURGLAR to hence describe a system as 10 which can provide dual protection against fire and burglary. It is, of course, understood that many other conditions can be implemented to further protect the premises such as a low temperature condition or a power failure and so on and would be considered as suitable alternate inputs.

As briefly indicated above, a manufacturer or maker of such systems would desire to inform the user that one or another condition exists and hence, this is implemented by utilizing a different sound alarm.

As shown in the FIGURE, a common loud speaker 15 is employed to produce one type of alarm for a fire and another type of alarm for a burglary. Briefly, the speaker 15 is driven by an audio amplifier circuit 16. The audio amplifier circuit to be described in detail is driven by a flip/flop 17. The flip/flop 17 is controlled in operation by a high frequency multivibrator and modulator circuit 18. Another flip/flop 19 operates in conjunction with the high frequency oscillator and modulator 18 to provide a wailing signal for the loud speaker 15 indicative of a burglar.

Before proceeding with a detailed description of the circuit operation, it is indicated that there are many ways of electronically producing high frequency signals as well as ways of driving and activating loud speakers and so on by using different circuit components as well as different circuit configurations which will become apparent to one skilled in the art. Therefore, the circuit to be described can be modified in various ways and is an example of a preferred embodiment.

If a fire is detected on the premises, the unit 10 will provide a positive signal on lead 20. This signal serves to forward bias diode 21. Diode 21 being forward biased, is coupled to a common bus 22 which serves to energize the various circuit components to be described and as shown in terms of the circuit schematic to be connected to and hence, activated by the common bus.

In this particular instance, the positive signal on lead 20 also serves to forward bias the diode 23 having its anode connected to line 20 and its cathode coupled to a set input of the flip/flop 19. For present purposes, it is sufficient to note that during a fire mode, flip/flop 19 is held in a set condition in order to cause the circuitry to produce a steady tone from speaker 15 indicative of a fire condition. It is ascertained from the diagram that the activation of lead 22 energizes the oscillator and modulator circuit 18. Basically, the oscillator portion of circuit 18 consists of an astable multivibrator which employs a first and a second COS/MOS gate connected to form a free running astable multivibrator or high frequency oscillator circuit. The use of COS/MOS gates enable one to provide economical and small sized apparatus which exhibit efficient and reliable operation.

As can be seen from the circuit, a first inverter 24 consists of a P and an N channel device having a source and drain electrode connected in common. The configuration depicted within dashed line 24 is commonly referred to as an inverter gate and is a well known component. The gate 24 is coupled to a second gate or inverter 25. The gate 24 has a common connection of the drain and source electrode applied to the common input gate electrode of inverter 25.

Shown coupled to this junction is a resistor 26 in parallel with the series combination of resistor 27 and drain to source path of a FET modulator transistor 28. The junction 29 of the parallel circuit thus described is coupled to the common gate input of the first inverter 24 via a resistor 30. The junction 29 is also coupled to the common drain to source connection of inverter 25 through a timing capacitor 31.

Briefly, the circuit operates as follows:

When the output of inverter 25 is high, the capacitor 31 becomes positively charged. The input to inverter 24 via resistor 30 is high and the output is low. During the fire mode, as will be further explained, the transistor 28 is saturated and hence, the parallel combination of resistors 26 and 27 which are returned to the output of inverter 24, provide a path to ground to discharge capacitor 31. As long as the output of inverter 24 is low, then the output of inverter 25 will be high. When capacitor 31 is charged, its voltage causes the output of inverter 24 to become high. As a result, the output of inverter 25 goes low and capacitor 31 is charged negatively.

The resistors 26 and 27 then provide a charge path for the supply voltage and capacitor 31 begins to charge to this voltage. It does so until the voltage approaches and passes through the transfer point of inverter 24 to cause the circuit to again change state and hence, the cycle repeats. The period or repetition rate of the oscillator is determined, of course, by the time constant afforded by capacitor 31 and resistors 26 and 27. The operation of this oscillator is well known in the art and in essence, is a free running circuit.

Many examples of other astable multivibrators or other oscillators are also known and such circuits employing bipolar transistors and so on would operate as well.

Generally such circuits as depicted above are able to provide oscillations by controlling the charging rate of a capacitor and then discharging the capacitor to provide a repetitive waveform. The frequency as well as the duty cycle of such R-C oscillators is a function of the transfer voltage of the switching devices such as the transistors, vacuum tubes, or in this case, the COS/-MOS inverter gates. The variation in transfer voltage affects the duty cycle and a true square wave at a fifty percent duty cycle can only be obtained when the transfer voltage occurs at the fifty percent point. The duty cycle and frequency are interrelated and any attempt to control the duty cycle results in a change in frequency. Furthermore, the transfer voltage is usually a function of power supply drift, temperature, device construction and hence, it is extremely difficult without complicated circuitry, to maintain a fifty percent duty cycle. As indicated above, a fifty percent duty cycle is desireably required to obtain efficiency in driving the loud speaker 15 at optimum power.

Hence coupled to the output of inverter 25 is the (CK) or CLOCK input of a flip/flop 17. Flip/flop 17 may also comprise COS/MOS circuitry, although any flip/flop circuit can be employed. The flip/flop 17 is referred to in the art as a D type flip/flop. The function of the flip/flop 17 is to divide the output signal from the astable oscillator 18 by two. The division of such a signal by a flip/flop as 17 is well known. The output signal from flip/flop 17 is always of a 50 percent duty cycle and completely independent of any duty cycle variation of the oscillator 18. The oscillator signal is applied to the clock input of the flip/flop 17. The output of the "low" side ($\bar{Q}$) is fed back to the data input. The Q output will change state each time a positive going clock signal is applied and hence, the output at the Q output is the oscillator signal divided by two and the duty cycle is exactly fifty percent.

Examples of a suitable circuit configuration for flip/-flop 17 is manufactured by RCA Solid State Division, Sommerville, New Jersey as the CD4013/CD4013A. Other types of suitable devices are sold and supplied by other manufacturers. The Q output of the flip/flop 17 is applied via a resistor 40 to the base electrode of a common emitter amplifier 41. The amplifier 41 has a collector load resistor 42 coupled to the supply bus 22 and an emitter resistor 43 returned to common.

The emitter of transistor 41 is coupled to the base electrode of a first transistor 44 arranged in a Darlington configuration. Transistor 44 has its collector coupled to the collector of transistor 45 and its emitter coupled to the base of transistor 45. The emitter of transistor 44 is returned to ground or a point of reference potential via resistor 46 while the emitter of transistor 45 is coupled directly to the point of reference potential. The common collector connection of transistors 44 and 45 is coupled to one terminal of the loud speaker 15, with the other terminal of the loud speaker being coupled to the supply bus 22 to hence provide operating potential to transistors 44 and 45 with the speaker coil acting as the load impedance for the Darlington configuration.

As indicated, the speaker 15 is energized by the amplified divided signal of a 50 percent duty cycle. This signal is not modulated and hence, provides an audible alarm at a frequency in the range of 750 to 2,500 Hz. For example, if the output frequency for a FIRE condition were to be 2,000Hz then oscillator 18 would be selected to provide an output of 4,000 Hz and the output from divider 17 would be 2,000Hz at a fifty percent duty cycle. It is also clear that the exact frequency is not important as the audible alarm will function accordingly even if the oscillator 18 drifted or varied in frequency. However, one is assured that the alarm speaker 15 always receives a fifty percent duty cycle signal due to operation of the flip/flop 17.

The above description related to the presence of a FIRE alarm signal on lead 20 and now a burglar alarm condition or mode will be described.

For a burglar alarm, lead 50 of module 10 is energized. The positive signal on lead 50 forward biases diode 51 and hence, the supply bus 22 is again energized. Since diode 21 is reversed biased, so is diode 23 and hence, flip/flop 19 is able to operate. Flip/flop 19 is also a D type device or is the same type of circuit component as flip/flop 17. The reason for this is that an integrated circuit manufacturer normally provides two identical devices on the same chip or within the same package. Hence, in employing such devices as 17, one would have another module as 19 readily available.

The module or flip/flop 19 is used in the burglary mode to provide a wailing signal for energizing the loudspeaker 15 as will be described. The flip/flop 19 has its clock input (CK) coupled to the $\overline{Q}$ output of flip/flop 17. The Q output of flip/flop 19 is coupled via a capacitor 52 to the D input; and the $\overline{Q}$ output is coupled to the D input via the parallel combination of a diode 53 and a resistor 54. The common terminal 55 of the capacitor, diode, resistor and the D input is coupled to the gate electrode of the modulator FET device 28 having its drain to source electrode in series with resistor 27, thus forming a part of the oscillator 18 feedback path. As indicated when the modulator FET 28 is saturated or biased on, the frequency output of oscillator 18 is, for example, 4,000Hz to provide a 2,000Hz divided signal at the output of flip/flop 17.

The steady tone is modified during the burglary mode to provide a wailing tone by modulating the output of the oscillator 18 as will be described. In a D type flip/-flop, the logic level present at the D input is transferred to the Q output during a positive clock transition. The flip/flop 19 receives a clock input from the $\overline{Q}$ output of flip/flop 17. Assume that the Q output of flip/flop 19 is high or positive, then the $\overline{Q}$ output of 19 is low. Hence, on the next clock pulse, Q will also go low due to the high signal at the clock input and the fact that the D input is also low due to resistor 54 and diode 53. Thus as Q goes low, $\overline{Q}$ will go high and capacitor 52 starts to charge via resistor 54. At the same time, the voltage at the D input will rise due to the clock pulses and hence, the Q output will change accordingly. The capacitor 57 is charging slowly and continues to charge until there is a sufficient level on the D input to cause the flip/flop 19 to transfer its state and hence, Q will go high and $\overline{Q}$ is low and the cycle begins again. Thus, the output of the flip/flop 19 as applied to transistor 28 is a sawtooth waveform and is applied to the gate of transistor 28. Thus, as the gate voltage of transistor 28 is varied, the output of the oscillator 18 varies. For example, when transistor 28 is saturated, the output of the oscillator 18 is at 4,000 cycles; if transistor 28 is off the frequency of oscillator 28 would be determined by resistor 26 which is much larger than resistor 27. Thus, the output of the oscillator is swept between a low and a high frequency creating the wailing tone. The output is again divided by divider 17 and hence, the duty cycle of the signal driving the speaker 15 is symmetrical as being a 50 percent duty cycle.

Hence, as described, the circuitry depicted serves to provide a steady tone for energization of lead 20 referenced as FIRE and a modulated tone for energization of lead 50 indicated as BURGLAR.

Certain components are indicated on the diagram and not fully explained. Resistor 30, for example, associated with the astable oscillator 18, is employed to reduce frequency shift of the oscillator for power supply variations. The resistor 61 and capacitor 62 associated with flip/flop 19 are used as an integrator to aid in maintaining the flip/flop 19 set during a fire alarm condition. The components as resistors 64,65 and capacitor 66 are used to filter and adjust the supply bus 22 to maintain a reliable DC level thereon during operation of the alarm circuitry as described.

As indicated, one may depart from the circuit configurations shown by employing other types of logic elements with different values without departing from the teachings of the invention. A typical alarm circuit employed the following components for providing the alarm operation described:

| COMPONENT | TYPE |
|---|---|
| Inverter 24,25 | RCA COS/MOS CD4000A, 4001A, 4002A or 4007A |
| Flip/Flop 17,19 | RCA COS/MOS CD4013 |
| Transistor 41 | 2N 3055 |
| Transistors 44, 45 | 2N 2219 |
| Resistor 26 | 82 Kilohms |
| Resistor 27 | 6.8 Kilohms |
| Resistor 30 | 150 Kilohms |
| Capacitor 31 | .01 Ufds. |
| Resistor 54 | 8.2 Megohms |
| Capacitor 52 | .05 Ufds. |
| Capacitor 62 | .05 Ufds. |
| Resistor 61 | 1 Megohm |
| Resistor 40 | 3.3 Kilohms |
| Resistor 42 | 220 ohms |
| Resistor 43 | 100 ohms |
| Resistor 46 | 27 ohms |
| Resistor 64 | 1,000 ohms |
| Resistor 65 | 100 ohms. |
| Capacitor 66 | 470 ufarads |

All diodes 21,23,51 can be any conventional semiconductor diode.

We claim:

1. A circuit for providing an audible alarm at a given frequency by energizing a loud speaker device at said frequency, said frequency provided by a RC controlled oscillator for providing a signal frequency at an output and having an undesireable variation in duty cycle to thereby result in a reduction in the power applied to said loud speaker, the improvement in combination therewith of apparatus for providing a fifty percent duty cycle to said loud speaker, comprising:

(a) a triggerable frequency divider coupled to said oscillator output and operative to divide said signal frequency by a factor of $2n$, where $n$ is a positive integer, said divider operative to provide a divided signal having a fifty percent duty cycle substantially independent of the frequency and duty cycle of said oscillator, and (b) means for applying said divided signal to said loud speaker device.

2. The circuit according to claim 1 wherein said RC oscillator comprises an astable multivibrator having a first switching device and a second switching device, each of said devices having an input control electrode and a first and second output electrode, with said first output electrodes connected together, a capacitor coupled between said second output electrode of said second device and the input electrode of said first device, with a connection of said second output electrode of said first device connected to the input electrode of said second device and a resistor coupled between said connection and said input electrode of said first device, said resistor and capacitor determinative of the frequency of operation of said multivibrator, with said first and second devices switching states according to a transfer voltage associated with said input electrodes to provide at said second output electrode of said second device, said signal frequency having an undesireable variation in duty cycle.

3. The circuit according to claim 1 wherein said triggerable frequency divider comprises a bistable multivibrator.

4. An alarm circuit for providing a first alarm signal indicative of a first condition and a second alarm signal indicative of a second condition, said first and second alarm signals being applied to energize a common loudspeaker for providing an audible alarm manifesting either said first or second conditions when energized by said first and second signals, comprising:

(a) a RC astable oscillator operative to provide a high frequency signal at an output, said signal characterized by having a variation in the duty cycle associated with said signal to cause said duty cycle to undesireably differ from one of approximately fifty percent, said RC oscillator including a timing resistor in a feedback path for determining the frequency of said oscillator, (b) an active device having an input control electrode and first and second output electrodes with said first output electrode coupled to one terminal of said resistor and said other output electrode coupled to said other terminal of said resistor, with said input electrode adapted to vary the impedance between said output electrodes when energized by a suitable control signal, (c) a bistable multivibrator having an input coupled to said output of said oscillator for providing at an output, a divided signal of substantially a fifty percent duty cycle independent of the duty cycle of said oscillator, (d) control means coupled to said control electrode of said active device and operative in a first mode for providing a constant impedance between said output electrodes to cause said oscillator to provide a relatively constant frequency indicative of said first condition, and in a second mode for varying said impedance and therefore said oscillator frequency to provide a wailing frequency indicative of said second condition, and (e) audio amplifier means having an input coupled to said output of said bistable multivibrator and an output coupled to said loudspeaker to energize said loud speaker with either one of said divided signals indicative of one of said conditions, whereby said loud speaker is energized by said divided signal of a duty cycle about 50 percent.

5. The alarm circuit according to claim 4, wherein said control means includes a second bistable multivibrator having an output electrode coupled to said control electrode of said active device and operative in a first state indicative of said first mode for providing a fixed level to said control electrode and including a resistance capacitor timing circuit coupled between an output and an input of said second multivibrator to provide a sweep voltage during a second mode for application to said control electrode for varying the impedance between said output electrodes during said second mode.

6. The alarm circuit according to claim 4 wherein said astable oscillator includes a first and a second COS/MOS inverter arranged in an astable oscillator configuration, with said timing resistor coupled between said inverters.

7. The alarm circuit according to claim 4 wherein said active device comprises a field effect transistor having a source output electrode, a drain output electrode and a gate control electrode.

8. The alarm circuit according to claim 4 for use in an intrusion system with said first alarm signal indicative of a fire alarm and said second alarm signal indicative of a burglar alarm.

9. The alarm circuit according to claim 4 wherein said audio amplifier means includes a Darlington amplifier configuration.

10. The alarm circuit according to claim 5 wherein said first and second bistable multivibrators are D type multivibrators.

* * * * *